US005722657A

United States Patent [19]

Cabrera

[11] Patent Number: 5,722,657

[45] Date of Patent: Mar. 3, 1998

[54] IRREGULAR POLYHEDRON PUZZLE GAME WITH PIECES OF ASYMMETRIC SHAPES

[76] Inventor: Dario Cabrera, Transversal 18 No. 77-18 Of. 706, Santa Fe De Bogota, D.C., Colombia

[21] Appl. No.: 650,798

[22] Filed: May 20, 1996

Related U.S. Application Data

[63] Continuation-in-part of Ser. No. 425,190, Apr. 20, 1995, abandoned.

[51] Int. Cl.[6] ..... A63F 9/08

[52] U.S. Cl. ..... 273/153 S

[58] Field of Search ..... 273/153 R, 153 S, 273/156

[56] References Cited

U.S. PATENT DOCUMENTS

| | | | |
|---|---|---|---|
| 4,451,039 | 5/1984 | Hewlett, Jr. | 273/153 S |
| 4,496,155 | 1/1985 | Goldfarb | 273/153 S |
| 4,500,090 | 2/1985 | Nieto | 273/153 S |
| 4,600,199 | 7/1986 | Krell | 273/153 S |
| 4,706,956 | 11/1987 | Abu-Shumays et al. | 273/153 S |
| 4,836,549 | 6/1989 | Flake | 273/153 S |
| 5,386,993 | 2/1995 | Apsan | 273/153 S |

FOREIGN PATENT DOCUMENTS

| | | | |
|---|---|---|---|
| 0042695 | 12/1981 | European Pat. Off. | 273/153 S |

*Primary Examiner*—Steven B. Wong

*Attorney, Agent, or Firm*—Pretty, Schroeder & Poplawski

[57] ABSTRACT

A puzzle game assembled with movable parts that form an irregular polyhedron volume with the appearance of a star of 6 points in the shape of pyramids of rectangular bases, in three pairs of opposed apexes, composed of 27 pieces, of which one is fixed and invisible and 26 are movable and visible, identified in three types of different shapes, A, B and C. The six A type pieces of pyramidal shape, rotate asymmetrically with regard to their opposing pieces, centered by pairs on the axes perpendicularly intersecting in the center of the toy. The twelve B type pieces, of asymmetric shape, translate asymmetrically with regard to the center of the toy and are initially ordered by pairs coordinated on three pairs of parallel axes with four horizontal and two vertical ones that are intercrossed eccentric and equidistant to the center of the toy. The eight C type pieces are diagonally coordinated with regard to the center of the toy. By making 90 degrees turns of the pyramids, the positions of the asymmetric shapes A and B are disordered, presenting visible distortion of the precise geometric shape of the star. The eight C type pieces are translated and remain forming the interior corners of the star. Various colors can be provided on the exposed surfaces of the pieces to increase the complexity of the puzzle.

9 Claims, 8 Drawing Sheets

FIG. 1 (50)

IRREGULAR POLYHEDRON PUZZLE GAME WITH PIECES OF ASYMMETRIC SHAPES

CROSS-REFERENCES TO RELATED ACTIONS

This application is a continuation-in-part of my application Ser. No. 08/425,190, filed 20 Apr. 1995, entitled LOGICAL SPATIAL TOY STAR now abandoned.

BACKGROUND OF THE INVENTION

1. Field of the Invention

This invention consists of a puzzle related to the logical spatial toys that appeared from the invention of "Rubik's Cube", which through mechanisms the integral parts can be redout or transferred in space, thus combining the logical positions originally assigned.

Generally logical spatial games consist of single shaped solids, such as cubes, pyramids, balls, and other configurations that generally correspond to simple forms. Their problems involve simple purposes like putting in order the sides. The solutions are only simple in appearance because they result to be very complex due to the great amount of position codes and the great amount of possible combinations, and so they are very difficult to resolve for most children and even for the majority of adults. Rubik's Cube is a registered trademark of Ideal Toy Corporation.

2. Description of the Prior Art

This invention is a new and improved variation of the logic spatial toys that form regular polyhedron volumes, like the Hexahedron known as "Rubik's Cube", that presents a puzzle game comprising twenty-seven pieces arranged as a cube with its six faces subdivided in nine sections that are interrelated and are superficially confused, mixing up the colors to offer the objective of ordering everyone of its faces on a same color. See Hungarian Patent No. 170062 granted in December 1977.

Another prior puzzle game provides a regular polyhedron volume, an Equilateral Tetrahedron, known as "Pyraminx", a registered trademark of Tomy Corporation. Its fundamental objective is to order or compose by colors the related surfaces of the nine triangular elements that form everyone of the four equilateral triangles which integrate the regular tetrahedron. See European Patent No. EP-42-695, Apr. 16, 1981.

U.S. Pat. No. 4,500,090 to ANTOLIANO NIETO, issued Feb. 19, 1985, discloses a central body in the shape of the regular polyhedron that forms a dodecahedron.

U.S. Pat. No. 4,496,155 to ISRAEL GOLDFARB issued Jun. 29, 1985, describes a game in a three-dimensional shape with an octahedron shape body, that is defined by a pair of interpenetrating tetrahedrons that present, with certain sights in the silhouette, the appearance of a six pointed star.

U.S. Pat. No. 4,706,956 to IBRAIM K. ABU-SHMAYS et al. issued Nov. 17, 1987, describes three-dimensional puzzle games that form regular solid polyhedrons, an octahedron and an icosahedron. An objective is to order the surfaces of the faces by their corresponding colors.

U.S. Pat. No. 5,386,993 to BERNARDO H. APSAN issued Feb. 7,1995, describes a regular octahedron with tetrahedrons rotatably mounted on each octahedron's face.

Generally, the puzzle games that form regular solid polyhedrons, provide for interchanging the surface positions of the movable pieces related by colors that must be ordered on the faces of the conformed regular polyhedrons.

Such puzzle games in the form of regular polyhedrons do not present mounted asymmetric pieces, and during the game, do not provide the feature of distorting the geometry of the polyhedron.

One object of the present invention is to present a puzzle game forming an irregular polyhedron volume with the appearance of a star of six points in the shape of rectangular base pyramids, ordered in three pairs of antagonistic apexes, composed by twenty-seven pieces: one fixed and invisible piece and twenty-six movable and visible ones of three types, A, B and C. Six of the movable pieces, the A type ones, can be rotated, varying asymmetrically with regard to their antagonists of axis, and vary their geometric relation with the lateral sections of the pyramids formed by the B type pieces. The B type pieces are of asymmetric shape, and are translated during the game, disorganizing or distorting the original geometrical shape of the star, offering the challenge of restoring it.

A second object of the invention is to present six A type pyramidal shape pieces of asymmetric variation that form the pyramids' apexes and their respective positions, arranged in three antagonist or opposed pairs respectively centered on the perpendicularly coordinated axes in the center of the toy to rotate, varying asymmetrically the related positions with regard to their antagonists and to the adjacent lateral sections or B type pieces that form the lateral parts of the pyramids of rectangular base.

A third object of the invention is to present the twelve asymmetric shape B type pieces, corresponding to the two lateral parts of the six pyramids of the star. The B type pieces are related in six pairs of antagonist shapes with opposite vertexes, longitudinally extended and coordinated on six eccentric axes that are intercrossed by parallel pairs, four horizontally and two vertically, intercepting coordinated axes X, X', Y, Y', Z and Z', equidistantly of their coordination point. The twelve B type pieces can be translated, changing the horizontal and vertical positions of the asymmetric shapes geometrically related with regard to their antagonists of axis, and to the A type pieces, and simultaneously change the superficially related position with regard to the adjacent C type pieces.

A fourth object of the invention is to provide examples to obtain a double purpose puzzle game by the disposition of three different colors that correspond to the pyramids surfaces of three pairs of antagonistic apexes, and for a model of greater difficulty in the resolution of the riddle, six different colors are disposed which correspond to each one of the pyramids' surfaces of the star. Other colors, brands or symbols configurations can be integrated in the skillful order of the toy.

Stated differently, it is an object of the present invention to create a spatial puzzle toy with the shape of a tridimensional 6-point star disposed to rotate. Each point is assembled with three parts to form a rectangular based pyramid 3×1. These toy elements can be changed from originally assigned positions to incorrect positions in space, determining the partial or total disarrangement of the precise shape of some of the six pyramids and thus deform partially or wholly from the precise shape of some of the six pyramids, and thus changing the original shape of the star. The game includes recovering the shape of the star by arranging the pieces in the logic position initially assigned in space.

A further object of the invention is to supply the basic components with colors to determine the greater or lesser difficulty of the riddle in the different models for different age groups. A model may be provided of only one color for children age five to eight years, of three colors for children eight to twelve years, and of six colors for children over twelve years.

SUMMARY OF THE INVENTION

A three dimensional puzzle toy composed by a total of 27 pieces which integrate an apparent solid with the shape of a spatial star with six points. Three elements of different shapes make up the 26 elements of the toy which are placed by means of assembling the solid in a determined logical position, each one programmed in respect to others in such a way that they provide the apparent solid of the star shape of the toy. Through rotation movements of the part forming the star points, with 90, 180 and 270 degrees rotations, the parts change progressively from the initial star programmed position to incorrect positions, with the parts mixed in an unorderly manner discomposing partially or wholly the shape of points of the star.

After five or more rotations of the initial set, the pieces are ordered in such a manner that the star disintegrates formally in space. The game consists in re-ordering the mixed pieces until they are put back in the correct position to once again form the original position of the star.

Besides the spatial disarrangement of the solid, six colors can be assigned to the visible surface of each of the six points to increase the difficulty of the puzzle. For an intermediate difficulty two opposed points can be colored with the same color which eases the riddle. Also advertising, brand, logotypes, emblems, figures in high relief or basrelief can be placed on the surfaces of the component in a pre-determined order varying the game. The three basic models of the toy with 1, 3 or 6 colors are designed to help exercise the activity of logical thinking focused at different age groups between five and eight years with one color, eight to twelve years with three colors and from twelve years up, the six color model.

DESCRIPTION OF THE PREFERRED EMBODIMENTS

Figure 1:
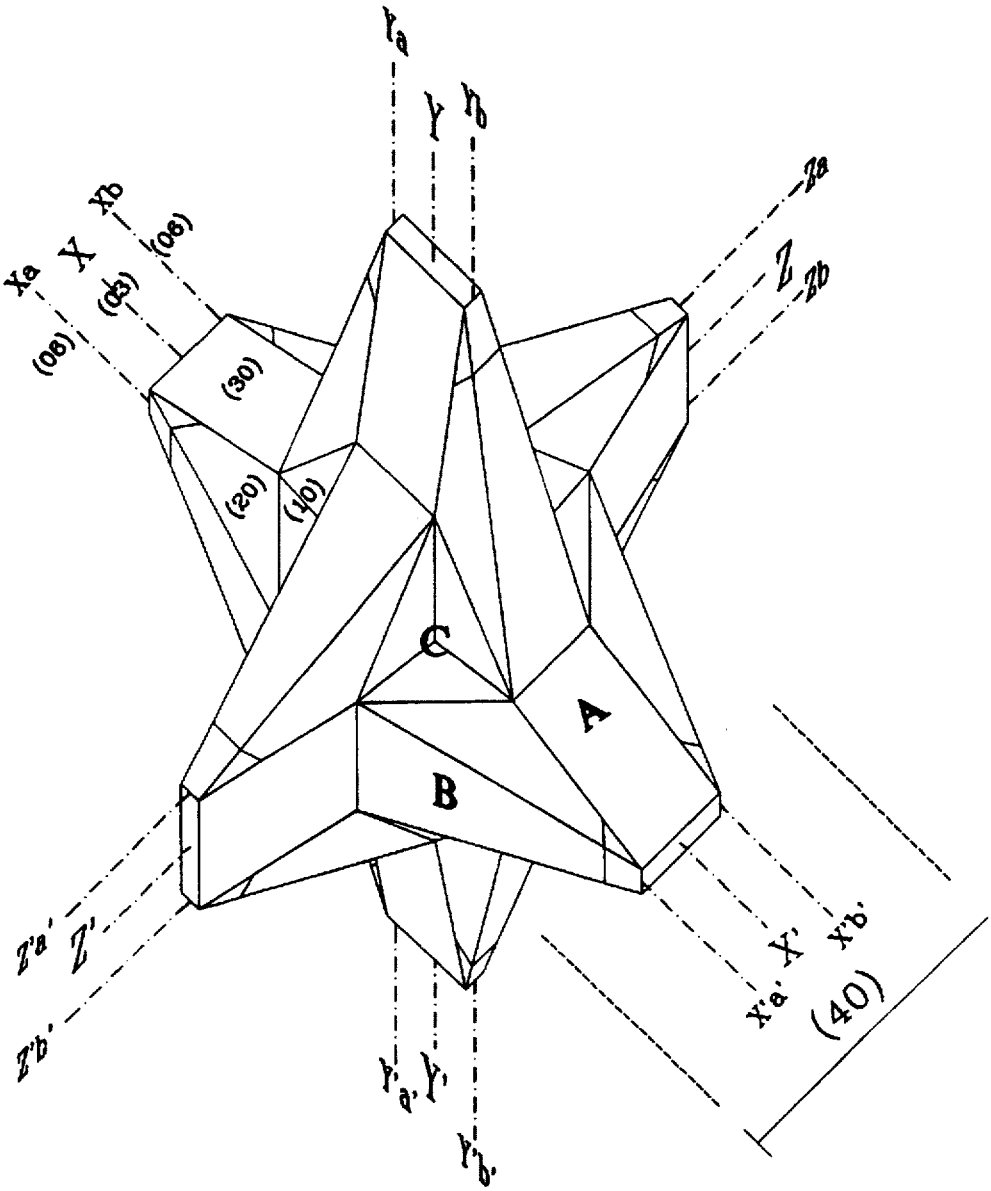
FIG. 1 shows the axonometrical view of the puzzle game, ordered in the initial toy position, comprising an irregular polyhedron solid with the geometrical shape of a star of six points in the shape of rectangular base pyramids 40 arranged in three pairs of antagonistic or opposed apexes extended longitudinally on the perpendicularly coordinated axes X–X', Y–Y' and Z–Z'.

The preferred embodiment as shown in FIG. 1, is a spatial puzzle toy comprising an interior fixed piece 0 and twenty-six mobile pieces grouped in three types, A, B and C, six, twelve and eight of each type, respectively, assembled in a determined position in space. The pieces are integrated with each other to provide the precise shape of the apparent solid of the spatial puzzle game of six tridimensional points simulating a six point star.

The elements A, B and C are assembled through rotation mechanisms which allow assembly and rotation movements with the hands, so that the elements A, B and C can change during the game from a previous programmed position in space to different or incorrect positions in space. Such changes produce many mixed states that present the solid of the star or some of its spatial points visibly disoriented or disintegrated in space, out of the logical order initially programmed. The game includes returning the disorganized mobile elements to the correct initial position of the shape of the solid of the star, as seen in FIG. 1.

More specifically the six A pieces are fastened to the fixed piece 0 or zero, with the twelve B pieces joined to the six A pieces, and the eight C pieces joined to the B pieces to complete the star shape of the game puzzle. The sequence of ordered placement of the three groups of movable parts, first group A, second group B and third group C, is shown using axonometric views to locate in space preferred positions of each one of the three part groups assigned with numbers as follows: number zero for the only fixed part, the parts identified with number 1, 2, 3, 4, 5 and 6 are type A, the parts identified with numbers 7, 8, 9, 10, 11, 12, 13, 14, 15, 16, 17 and 18 correspond to the twelve preferential positions of the twelve parts of type B, and the parts identified with the numbers 19, 20, 21, 22, 23, 24, 25 and 26 type correspond to the eight parts of type C, for a total of 27 parts.

Figure 2:
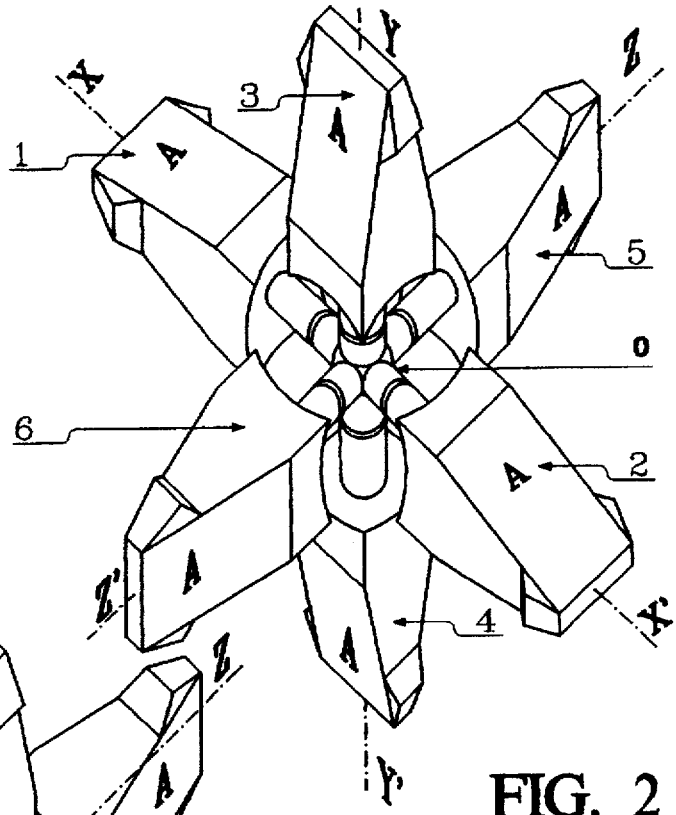
FIG. 2 shows a partial assembly including six A type pieces 30 adjacently mounted on the fixed piece 0, perpendicularly centered on the coordinated axes X–X', Y–Y' and Z–Z'0 of the toy. The components are arranged in corresponding positions by antagonistic pairs, ordered by the parallel planes of triangular surfaces, longitudinally extended, and can rotate changing selectively their relating positions asymmetrically with regard to their coordinated antagonists and they also may change their related positions with regard to the laterally corresponding B type pieces 20 in the geometrical composition of each one of the six pyramids (B–A–B) 40 of the star 50.
Figure 3:
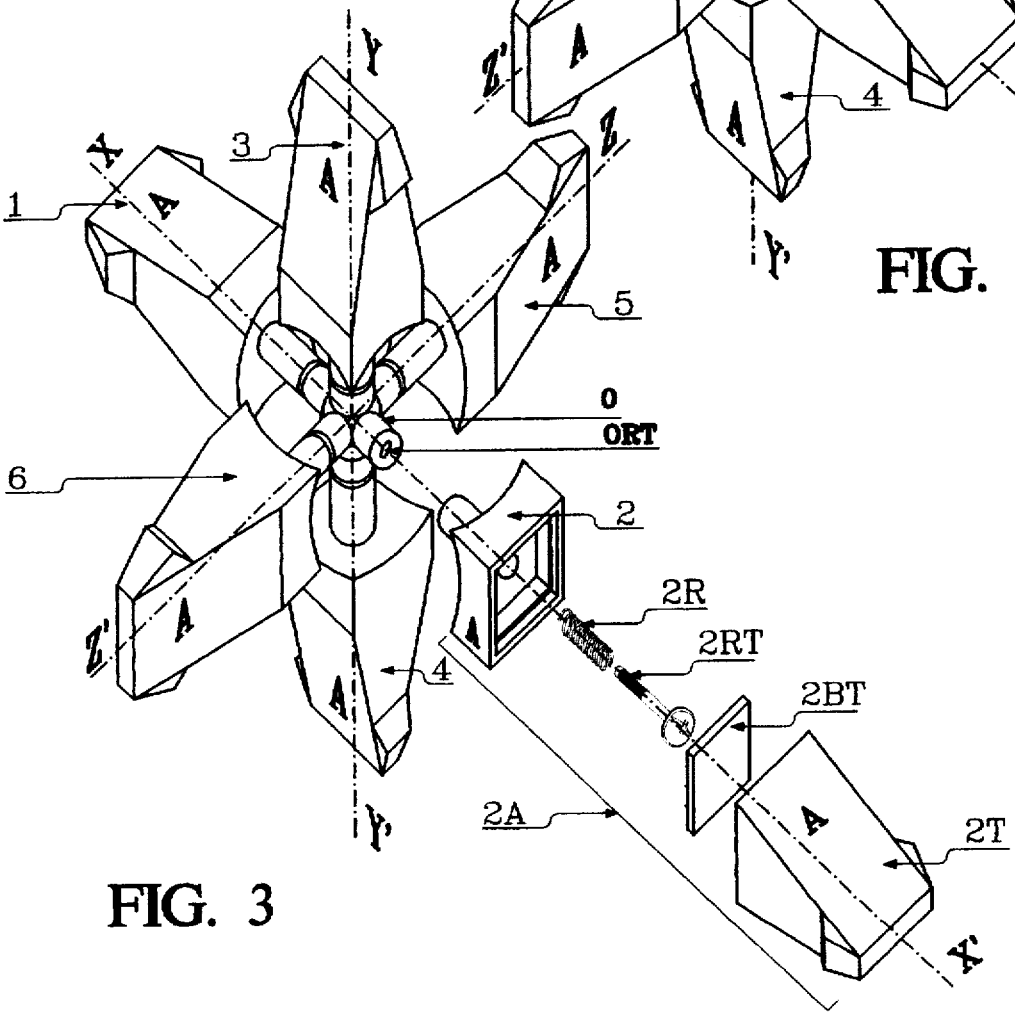
FIG. 3 shows in detail the partial assembly of the A piece 30, the location of its base 2A, one of the six springs 2 and one of the six screws 2T. This construction allows the assembling of the toy, and the tightening and rotation of the six A type pieces 30. The pyramidal cover 2T located on the 2BT base adjusts the composite A piece 30 to allow the access to the screws that thread into the six 6ORT holes of the fixed piece 0 to originally assemble the toy.

FIG. 2 shows the position and partial assembly 0+6A of the six pieces denominated type A, which comprehend the six central points of the six pyramids of the star. These pieces are centered with six screws and six perpendicular springs to rotate as one set over piece zero, located at the point where the three spatial axes x–x', y—y, and z–z' of the star intercept. FIG. 3 shows the detail of the positions of the base 2A, spring 2R, screw 2RT, and the base of cap 2BT and the pyramidal cap 2T, which form a piece A, for the fastening and rotation of the six pieces A (A1, A2, A3, A4, A5 and A6).

Figure 4:
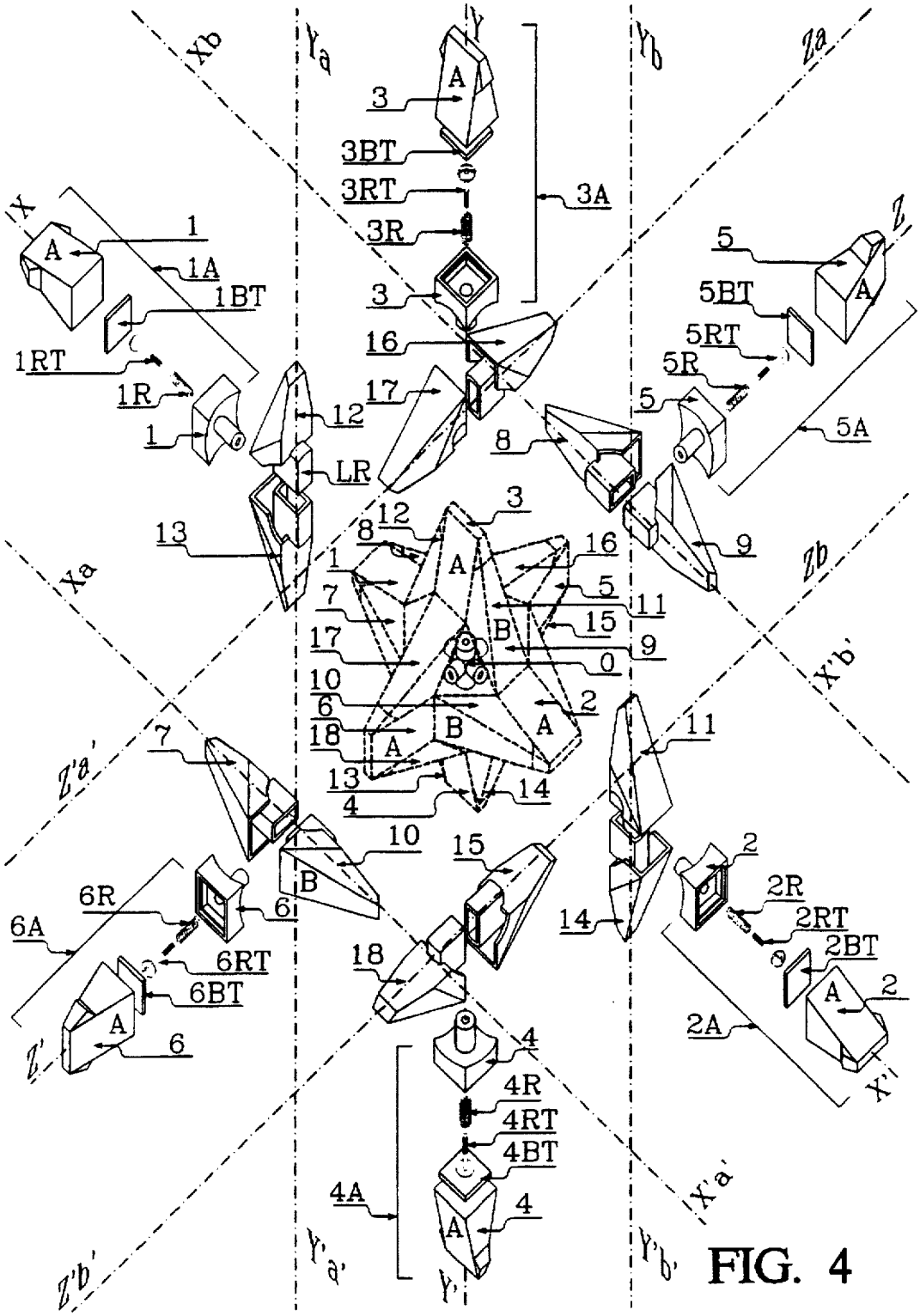
FIG. 4 shows the projected partial assembly 0+6A+12B. The twelve B type pieces 20 are asymmetrically mounted on the six A type pieces 30 and retained in cavities by means of retention cams LR. The twelve B type pieces 20 present asymmetric shapes that are originally pairs of pyramidal shapes, longitudinally extended, with antagonistic apexes corresponding in eight horizontal and four vertical positions coordinated on three pairs of parallel axes 6 that are eccentrically intercrossed, four horizontal and two vertical ones, intercepting the coordinated axes X–X', Y–Y', and Z–Z' equidistantly to their coordination point 0.

FIG. 4 shows 0+6A+12B and the detail of the location of the partial assembly of the twelve translation pieces denominated type B assigned the numbers 7 to 18, that by pairs make up the twelve lateral parts of the six pyramids of the spatial star. The twelve pieces of group B are fastened by means of an assembly of retention cams, connected to the cavities of the twelve lateral faces of pieces type A. FIG. 4 also shows the projected position of the partial assembly of the six mounted points with 0+6A+12B and the three dimensional location of the twelve B parts which serve as a guide to the location of the toy forming the spatial star.

Figure 5:
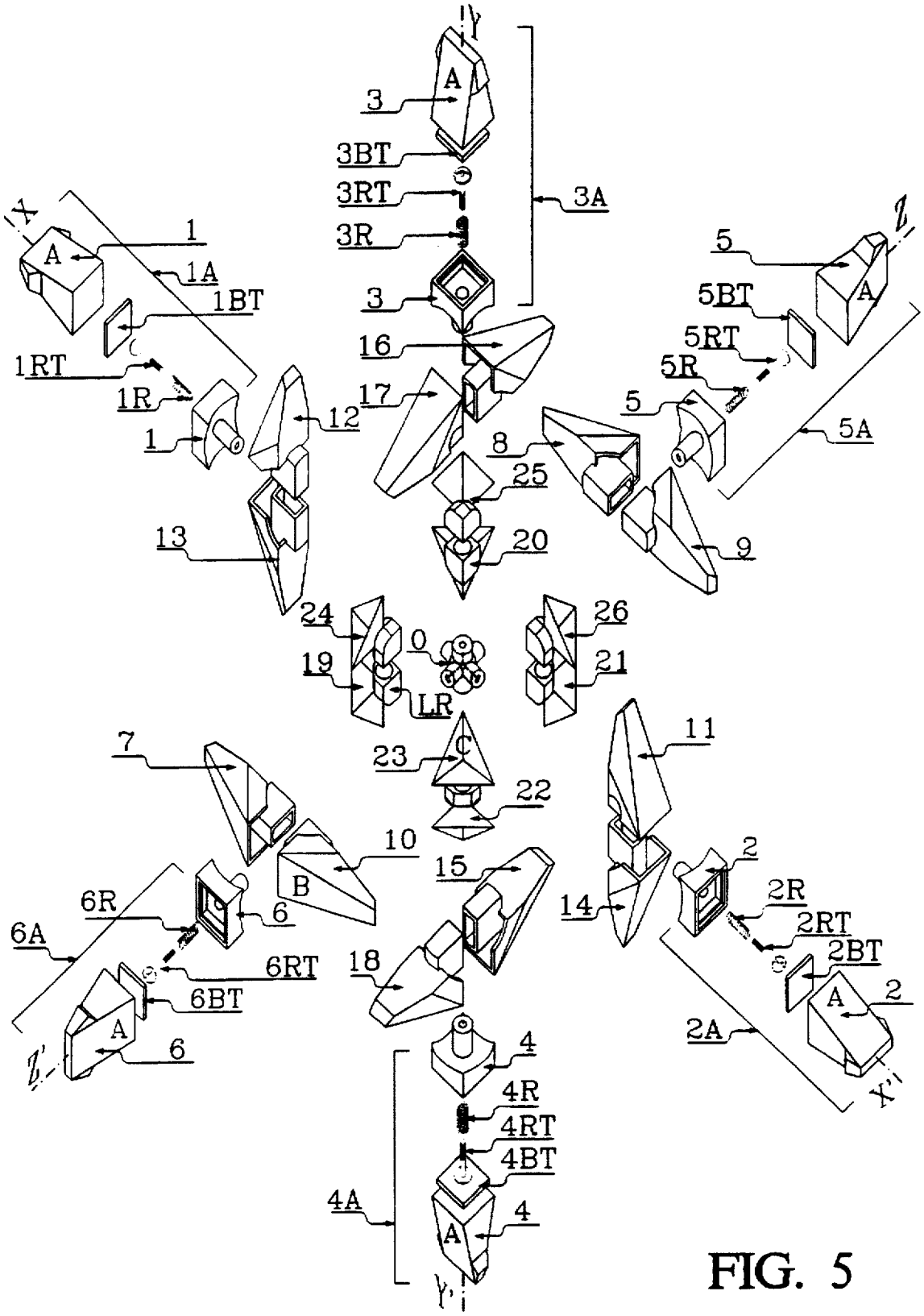
FIG. 5 shows the complete assembly of the toy 0+6A +12B+8C. The eight C type pieces 10 are adjacently mounted on the twelve B type pieces 20 and retained by these, in cavities, by means of retention cams LR, occupying the eight internal corners of the star's geometry 50 integrating the toy in a whole.

In FIG. 5 the location and the position of the eight translation pieces C, with number 19, 20, 21, 22, 23, 24, 25 and 26 is shown. These pieces provide the eight internal triangular vertexes and are retained with cams in the eight cavities of the eight corners formed by the twelve type B pieces. FIG. 5 also shows the position in space of all the 26 pieces types A, B and C which make up the star, joined by the only fixed piece not visible of the toy.

The difficulty of the puzzle may be changed for different age groups by the use of color. A model with only one color requires only the resolution and recovery of the shape of the star, and is focused to children from five to eight years old. A model using three colors disposed in three pairs of opposing points x and x' one color, y and y' the second color, and z and z' the third color is focused to children from eight to thirteen years. A model using six colors disposed in each of the six spatial points of the star is of the greatest difficulty and focused to children thirteen years or older. In addition to or in lieu of color, advertisements, trademarks, emblems and other symbols of any type can be incorporated in the various elements.

Figure 6:
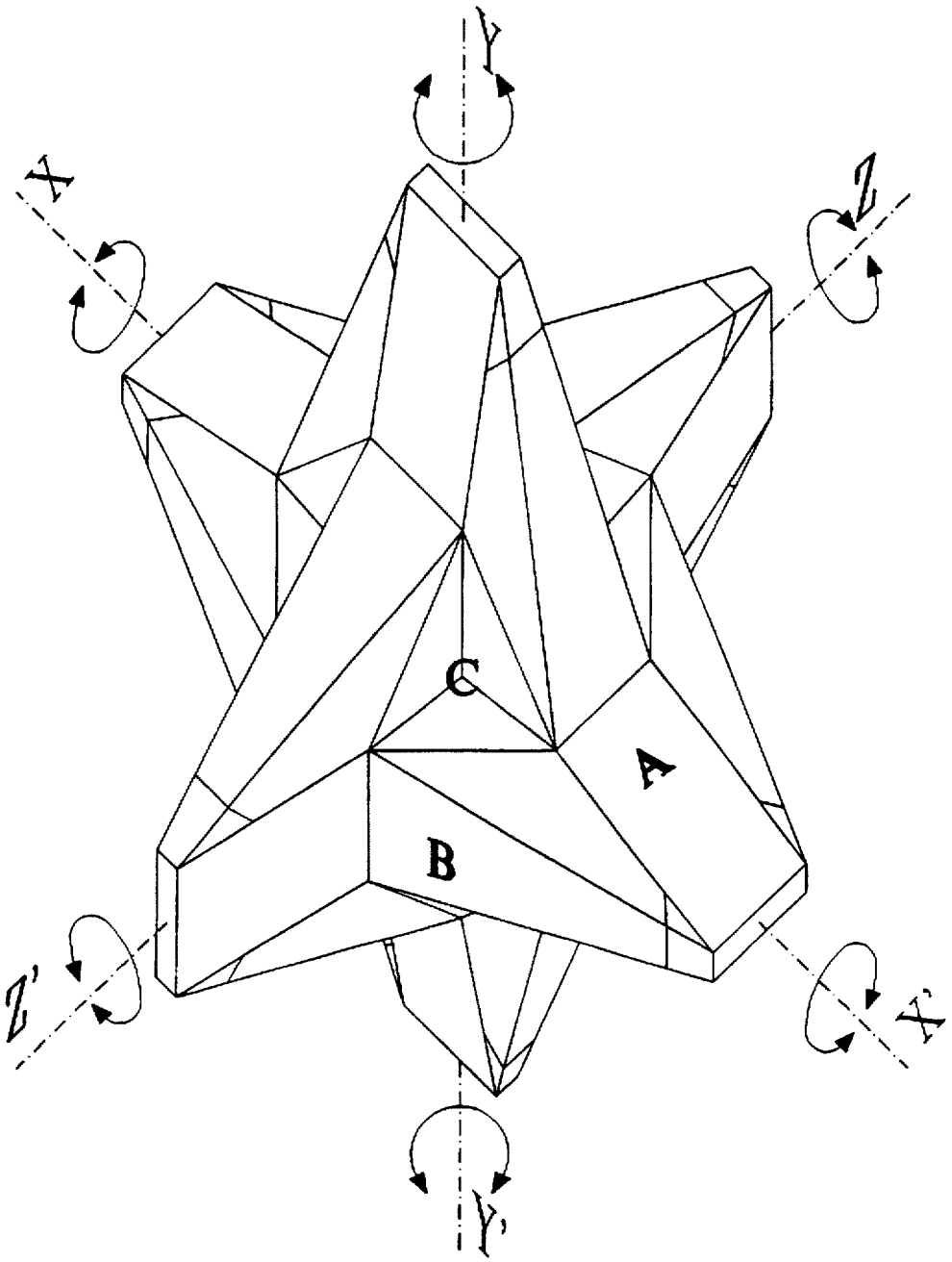
FIG. 6 shows the irregular polyhedron puzzle game with eighteen pieces [6 A type 30+12 B type 20] of asymmetric shapes that are geometrically interrelated, and eight C type pieces 10 that occupy the interior corners of the star. The C type pieces may or may not be superficially or surface related, for example, by means of colors corresponding with the colors of the B type pieces 20. The star is arranged to start the game by rotating selectively the pyramids with 90 degrees turns to mix up the asymmetric A 30 and B 20 pieces in uncoordinated geometrical positions, presenting noticeable distortion in the space the geometry of the pyramids 40 of the star 50.
Figure 7:
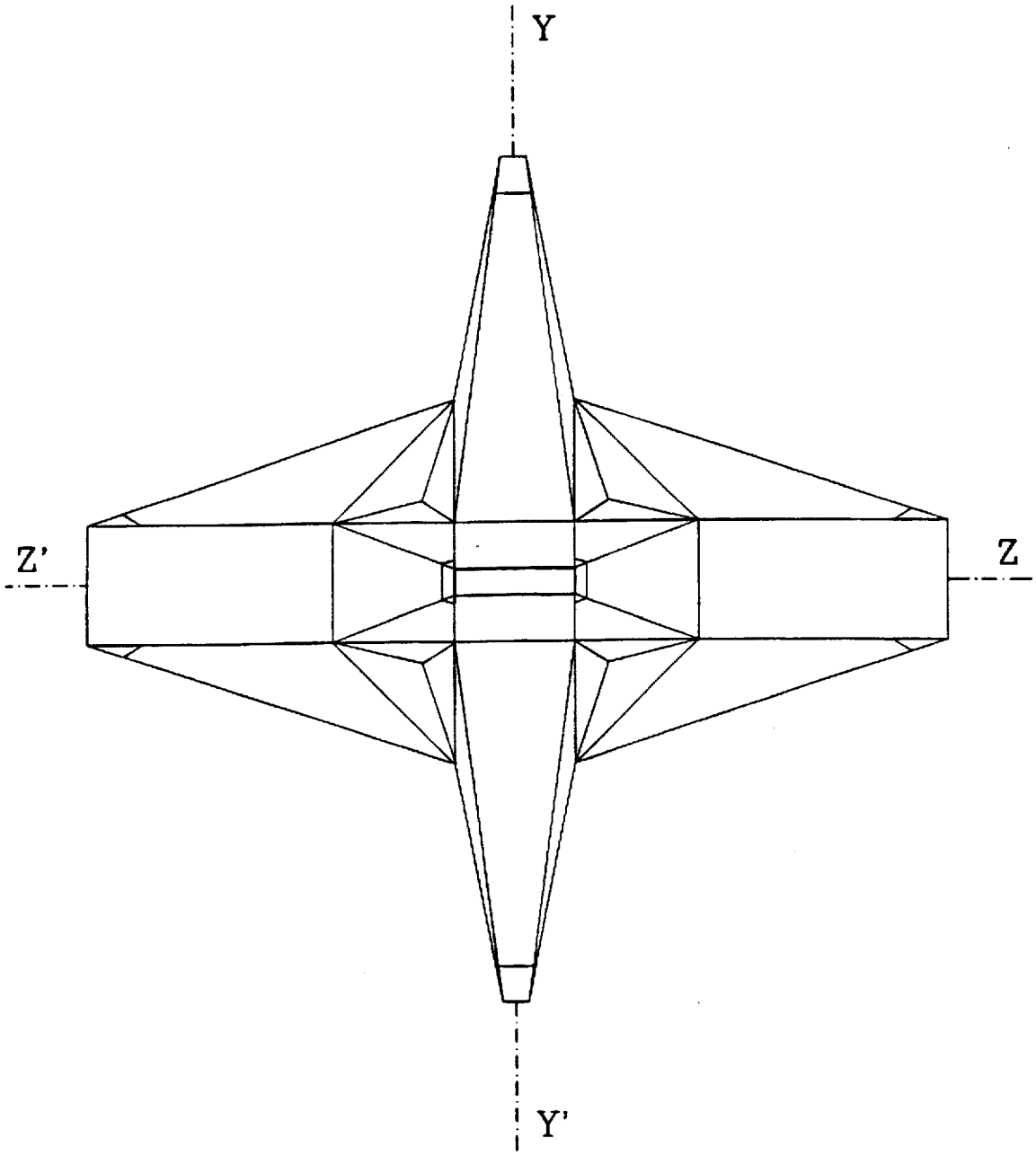
FIG. 7 shows a lateral view of the toy from its X–X' axis.
Figure 8:
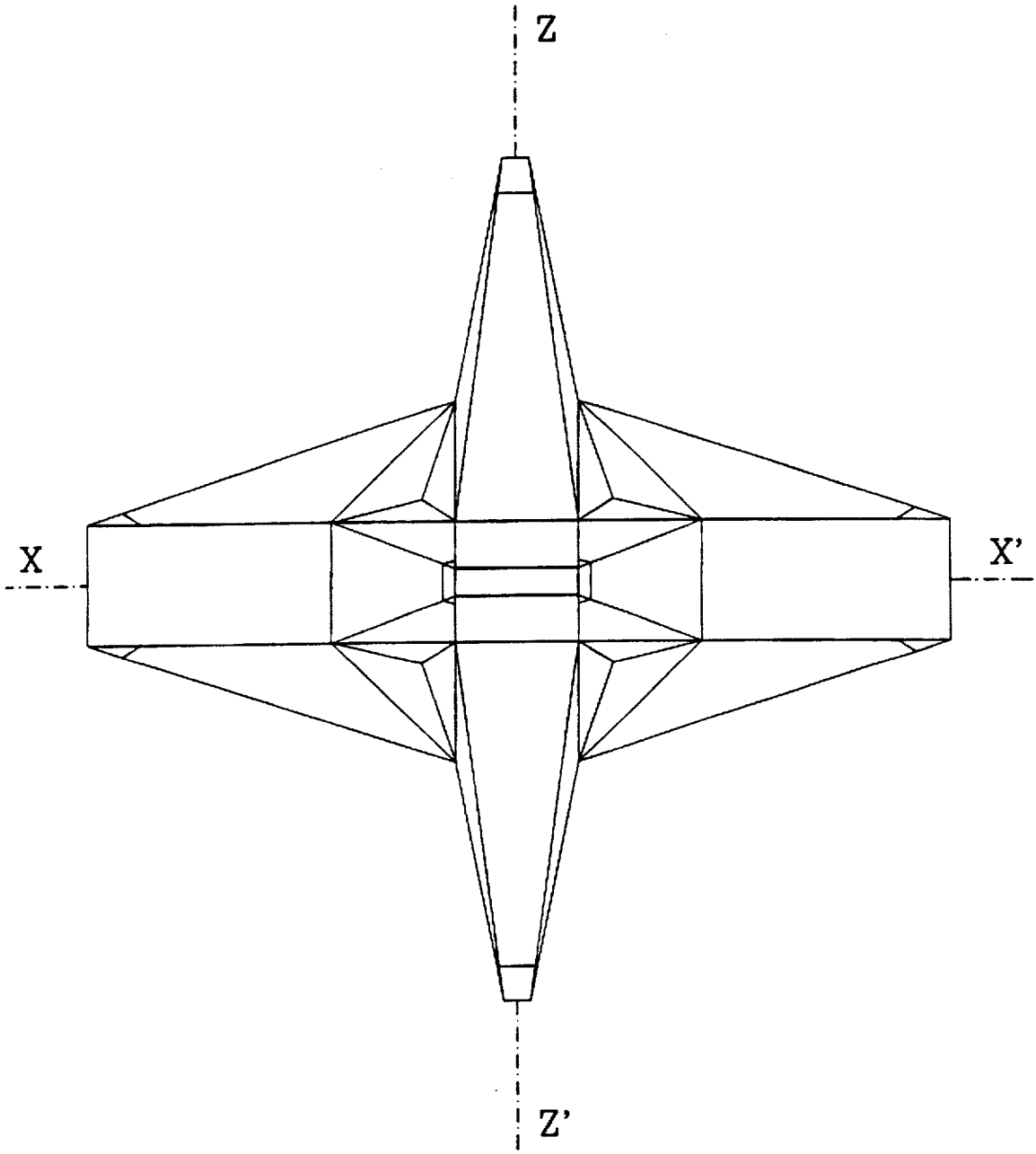
FIG. 8 shows a lateral view of the toy from its Y–Y' axis.
Figure 9:
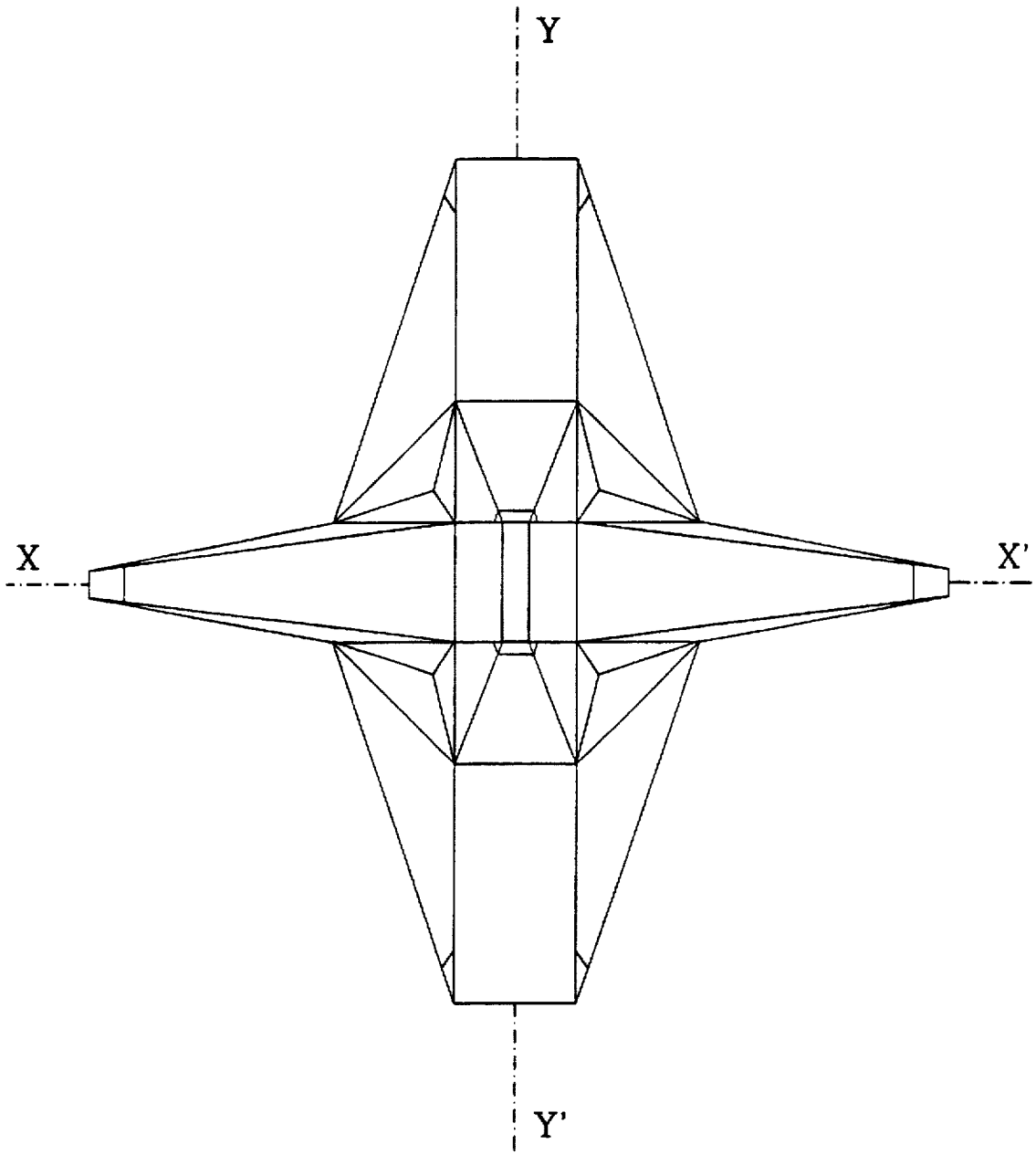
FIG. 9 shows a lateral view of the toy from its Z–Z' axis.

For a further understanding of the drawings related with the objectives that are subject of the actual invention, the ordered arrangement sequence of the three groups of movable parts is presented, first the group A type pieces 30 adjacent to the fixed piece zero or 0 in FIGS. 2 and 3, secondly the group of B type pieces 20 in FIG. 4 and thirdly the group of C type pieces 10 in FIG. 5, using axonometrical exploded views to place in the space the forms in the respective positions of each one of the three groups of different pieces that comprise the toy in its pristine position. The pieces 1, 2, 3, 4, 5 and 6 in FIG. 2 correspond to the preferred positions of six A type pieces 30 of asymmetric shapes, ordered by antagonistic pairs with regard to the coordinated axes X–X', Y–Y' and Z–Z'. The pieces 7, 8, 9, 10, 11, 12, 13, 14, 15, 16, 17 and 18 in FIG. 4 correspond to the twelve preferred positions of the twelve B type pieces 20, of asymmetric shapes, ordered by antagonistic pairs, coordinated on six eccentric intercrossed parallel axes. Four horizontal axes coordinate eight horizontal B type pieces 20: (Xa–X'a') parallel with (Xb–X'b') intercrossed with (Za–Z'a') parallel with (Zb–Z'b') and two vertical parallel axes respectively intercrossed (Ya–Y'a') parallel with (Yb–Y'b') coordinate four vertical B type pieces 20. The pieces 19, 20, 21, 22, 23, 24, 25 and 26 in FIG. 5 correspond to the eight C type pieces 10 coordinated by pairs, conforming diagonally the eight interior corners of the star for a total twenty-six movable and visible pieces integrated by the fixed and invisible piece 0, presenting the irregular polyhedron puzzle game in the shape of a six pyramid star ready to play (FIG. 6).

The puzzle is assembled with the rotation mechanisms that allow turning movements with the hands so that A type 30 asymmetrically shaped pieces rotate and the B type 20 ones translate, changing their positions geometrically related 6A+12B to a number of different or incorrect positions during the game, producing the mixed up states that during the game presents the original geometry of the star 50 or some of its pyramidal points 40 visibly distorted or disarranged in the space. The game offers the challenge of returning all the asymmetric A and B type pieces 30, 20 engaged in the geometrical distortion of the star 50 to their original positions. The C type pieces 10 are translated simultaneously with the B type 20 ones and must be repositioned when they are superficially related in the color models corresponding to the colors of the B type pieces 20.

The partial assembly of 0+6A pieces is shown in FIG. 2. The A type pieces 30 that present asymmetric geometric shapes, assembled to rotate centered on the axes 03 perpendicularly coordinated X–X', Y–Y' and Z–Z' with the center of the toy 0, are located in six positions respectively coordinated in three pairs of antagonistic shapes, that are symmetrically related by their parallel planes of triangular surfaces, longitudinally extended on the axes and are presented screwed and centered to rotate adjacent on the fixed piece zero. The A type pieces 30 play by means of selective rotations of 90 degrees, changing their positions asymmetrically with regard to their antagonists and to the two B type pieces 20 that originally correspond to them, adjacent the parallel triangular extended planes.

The 2A base detailed assembly of the 2R spring, the 2T screw, the 2BT bases cover and the 2T pyramidal cover building up the composite A piece 30 to allow the assembly of the toy with the fixation of the screws that maintain tightened the A type pieces 30 and allow their rotation is shown in FIG. 3. The six A pieces 30 are connected to the fixed piece zero 0 by means of cylindrical pivots, conforming the cavities where fit adjacently the cams LR that retain the corresponding B type pieces 20. The three pairs of antagonist A type pieces 30 marked in FIGS. 2 and 3 with numbers 1, 2, 3, 4, 5 and 6 are related coordinated in respective positions on the axes:

Axis X coordinates the piece marked with number 1.
Axis X' coordinates the piece marked with number 2.
Axis Y coordinates the piece marked with number 3.
Axis Y' coordinates the piece marked with number 4.
Axis Z coordinates the piece marked with number 5.
Axis Z' coordinates the piece marked with number 6.

The partial assembly of 0+6A+12B is shown in FIG. 4. The twelve B type pieces 20 of pyramidal geometric shapes, asymmetrically mounted with regard to the center of the toy 0, are originally located in twelve respective positions arranged in six pairs of geometric pyramidal shapes of opposite apexes, longitudinally extended and coordinated on three pairs of eccentric parallel axes 06 that are intercrossed equidistant to the center of the toy 0. FIG. 4 shows the detail of the respective positions and locations of the twelve B type pieces 20 numbered 7, 8, 9, 10, 11, 12, 13, 14, 15, 16, 17 and 18. These are of pyramidal shapes, extended and mounted in asymmetric positions with regard to the center of the toy, and arranged adjacent to the A type pieces 30, conforming the twelve lateral sections of the six pyramids of rectangular base 40 of the star 50.

The pieces marked in FIG. 4 with the numbers:

7 and 8 are for pyramid number 1.
9 and 10 are for pyramid number 2.
11 and 12 are for pyramid number 3.
13 and 14 are for pyramid number 4.
15 and 16 are for pyramid number 5.
17 and 18 are for pyramid number 6.

The respective order of the twelve asymmetric positions of the twelve B type pieces 20 with corresponding pyramidal shapes by pairs of opposite apexes extended on the coordination axes 06 relate with four axes coordinating eight pieces of asymmetric shapes in horizontal position and two axes coordinating four pieces of asymmetric shapes in vertical position:

Horizontal ones

Axis Xa coordinates the piece marked with number 7.
Axis X'a' coordinates the piece marked with number 10.
Axis Xb coordinates the piece marked with number 8.
Axis X'b' coordinates the piece marked with number 9.
Axis Za coordinates the piece marked with number 16.
Axis Z'a' coordinates the piece marked with number 17.
Axis Zb coordinates the piece marked with number 15.
Axis Z'b' coordinates the piece marked with number 18.

Vertical ones

Axis Ya coordinates the piece marked with number 12.
Axis Y'a' coordinates the piece marked with number 13.
Axis Yb coordinates the piece marked with number 11.
Axis Y'b' coordinates the piece marked with number 14.

By 90 degrees rotations, one A type piece 30 changes position asymmetrically with regard to its antagonist and, simultaneously, four B type pieces 20 are translated changing the horizontal asymmetric positions by vertical ones or vice versa, perpendicularly articulating the eccentric axes 06, changing the original position of the geometrical shape related with regard to its antagonist of axis as well as the parallel plane with the A type piece 30 and, simultaneously, in each turn, four of the eight C type pieces 10 during the game are translated and remain in the eight interior corners of the star adjacent to the B type pieces 20, and when colors are used, related by colors with the B type pieces 20.

FIG. 5 shows the corresponding placing of the eight C type pieces 10 related with the whole set of parts in the respective positions that complete the irregular polyhedron star. The eight C type pieces 10 marked with numbers 19, 20, 21, 22, 23, 24, 25 and 26 are in pairs on four axes diagonally coordinated to play by translation movements with regard to the center of the toy, alternating in four pairs of antagonist positions. The three triangles of the surfaces of the C type pieces 10 may be presented related in the puzzle by means of three different colors, assigned with the colors of the three B type pieces 20 that correspond to them.

The puzzle game of the present invention provides an irregular polyhedron volume with the appearance of a star of six points in the shape of pyramids of rectangular base (3×1), assorted in three pairs of antagonistic apexes, integrated by twenty-seven pieces, of which one is fixed and invisible, and twenty-six are visible and movable ones, identified in three types of different shapes, positions and movements: A, B and C. The six A type pieces 30 of pyramidal shape, with two parallel planes of triangular surfaces, are respectively centered by pairs in positions of opposite vertexes to rotate on six axes 03 coordinated perpendicularly in the center 0 of the toy 50. The A type pieces play with a 90 degree turn, changing position asymmetrically with regard to their antagonists and to the type B pieces 20 extended adjacent by the parallel planes of triangular surfaces, conforming the lateral parts of the pyramids of rectangular base. The twelve B type pieces 20 have pyramidal shape with a parallel plane adjacent to the A pieces. They are found longitudinally extended by pairs of opposite apexes and asymmetrically mounted with regard to the center 0 of the toy 50, and coordinated in twelve respective positions on three pairs of parallel axes arranged, four horizontal and two vertical ones intercrossed, intercepting eccentrically the six coordinated axes 03, equidistantly to the coordination point 0. The B type pieces play by translation movements, changing the position of the asymmetric shapes related with regard to the A type pieces and to their antagonists of axis, articulating the eccentric axes, varying the horizontal positions for vertical ones or vice versa, and, simultaneously, changing the surface's relation with regard to the adjacent C type pieces that remain conforming the internal corners of the star. The C type pieces play with diagonal movements, remaining, during the game, related without presenting variations to their shape with regard to their antagonists of axis, and they can present superficial combinations, for example, with colors that correspond to the ones of the B type pieces surfaces. By means of 90 degrees sequence turns of the pyramidal points, the asymmetric A type pieces rotate and the asymmetric B type pieces .are translated, uncoordinating the respective positions of the shapes geometrically interrelated, presenting greatly distorted in the space the precise geometric shape of the star. Four of the eight C type pieces are simultaneously translated in every turn, and remain conforming the eight internal corners of the star. The C type pieces may be found related in the puzzle game in the models arranged by colors. By means of the pyramidal points rotations, the game offers the challenge of returning to their respective positions all the pieces engaged in the geometric distortion of the star and, in addition, for double puzzle games the surfaces of the star's pyramidal points can be arranged by colors.

The three-dimensional puzzle game invention provides an irregular polyhedron with the appearance of a star 50 of six points which have the shape of pyramids with rectangular bases, arranged in three opposing pairs centered on an invisible and fixed piece of the toy. The construction maintains integrated the mechanism composed of twenty-six visible and movable pieces, of three types of shapes A, B and C, arranged on axes of the polyhedron. The six A type pieces move on axes perpendicularly coordinated with regard to the center of the toy, the twelve B type pieces move eccentrically coordinated on three pairs of parallel eccentric and intercrossed axes, four horizontal and two vertical ones, intercepting the coordinated axes equidistant to the center of the toy, and the eight C type pieces move diagonally coordinated with regard to the center of the toy.

The one fixed piece receives the six adjacent A type pieces mounted to vary in position asymmetrically with rotating movements, which in turn receive and retain the twelve B type pieces, providing translation movements. The B type pieces receive and retain the eight C type pieces in diagonal positions with translation movements to complete the star in the initial geometric position of the puzzle game ready to play.

The three-dimensional toy in the form of an irregular polyhedron is assembled with asymmetrically shaped pieces having rotatory and translation movements. These pieces are geometrically interrelated, presenting the feature of varying in the space the position of the geometric shapes, disarranging the order of the respective positions of the pieces that originally form the star. During the game, the pieces are uncoordinated or disoriented or, rearranged by 90 degrees turns. The interrelated A and B pieces change progressively to geometrical positions different from the originally related ones, presenting a great disarrangement of the precise geometrical shape of the points or pyramids of the star. The game offers the challenge of returning all the A and B parts to their original positions. The mounting mechanisms can include systems with projecting spheres, pushed by springs, that fit in cavities in the adjacent internal surfaces, or others used in puzzles of this type.

While several embodiments subject to this invention have illustrated and described, it will be understood that these are by way of illustration only and that additional changes, extensions and modifications may be contemplated in this invention within the scope of the following claims.

I claim:

1. A puzzle game assembled with pieces in the form of an irregular polyhedron having the shape of a star of six points with at least eighteen movable and visible pieces and one fixed and invisible piece;

six of said pieces being A type of asymmetric shape for movement and twelve of said pieces being B type of asymmetric shape for movement and asymmetrically mounted in eighteen positions geometrically interrelated; and including means for varying the related positions of said pieces during the game, including disarranging the geometric order of the original form of the star to a different order, and for restoring said original form of the geometric order.

2. A game as defined in claim 1 including eight additional movable and visible pieces of C type movement and positionable in the eight interior corners of the star formed by said B type pieces.

3. A puzzle game assembled with pieces in the form of an irregular polyhedron having the shape of a star of six points with twenty-six movable and visible pieces and one fixed and invisible piece;

six of said pieces being A type of asymmetric shape for movement, twelve of said pieces being B type of asymmetric shape for movement mounted in eighteen positions geometrically interrelated, and eight of said pieces being C type for movement and positionable in the eight interior corners of the star formed by said B type pieces; and including means for varying the related positions of said pieces during the game, including disarranging the geometric order of the original form of the star and restoring said original form of the geometric order, and wherein said A type pieces are in the shape of square base pyramids with two parallel sides and two non-parallel sides, and said B type pieces are of geometric shapes asymmetrically arranged with regard to the center of the game and originally located in twelve positions corresponding in six opposed pairs longitudinally extended coordinated on three pairs of eccentric parallel axes that are intercrossed intercepting the coordinated axes of the star shape equidistantly to the geometric center of the toy presenting coordinates on two pairs of horizontal axes respectively intercrossed with one pair of vertical axes that correspond to the conformation of the star.

4. A game as defined in claim 3 including different colors on the surfaces of said A type pieces and relating colors on the surfaces of said C type pieces.

5. A logical space puzzle game that forms an irregular polyhedron in the shape of a three dimensional star assembled in a space body of 6 ends that have pyramidal shape with rectangular bases, which includes a fixed part and 26 mobile parts identified in three groups of different shapes, including 6 A members, 12 B members and 8 C members, and means to mount and turn said members as a whole, where said type A members have a specific shape, game and location geometrically related to the said B type members, which present geometric shapes asymmetrically arranged with respect to the center of the game and originally located in 12 places corresponding to 6 opposed pairs longitudinally extended and coordinated in 3 pairs of excentric parallel axes which are intercrossed and intercept the coordinated axes of the star shape equidistantly to the geometrical center of the game that presents coordinates in two pairs of horizontal axes respectively intercrossed with a pair of vertical axes that correspond to the shape of the star, and the 18 A and B pieces distributed in a determined position within the space to logically shape the 6 pyramid space star, arranged in 3 opposed pairs in 3 dimensions which pieces may be independently turned with the hands on 3 mutually perpendicular axes of the game to change the 18 geometrical interrelations (6A plus 12B) of said pieces within the space, disarranging the original symmetrical shape of the polyhedron and offering the challenge of recovering it.

6. A three dimensional star as defined in claim 5 with 6 ends showing the characteristic that each of the 6 ends is assembled by means of a type A member with a specific location and two type B lateral adjacent members which in the whole (1B plus 1A plus 1B) form a pyramid that has a rectangular base.

7. A three dimensional star as defined in claim 6 with 6 pyramidal ends that includes 6 type A members characterized by their geometrical shape with two parallel sides and two converging sides.

8. A three dimensional star as defined in claim 7 with three pyramidal ends that includes 6 type A members characterized by their specific location where 3 pairs of said A pieces oppositely correspond in their parallel sides on their coordinated axes.

9. A three dimensional star as defined in claim 8 wherein said members of the type B side define 8 interior corners that contain said 8 type C mobile and visible coupling members that may be positioned in said corners.

* * * * *